US009161587B2

(12) United States Patent
Green

(10) Patent No.: US 9,161,587 B2
(45) Date of Patent: Oct. 20, 2015

(54) HARDHAT MOUNTED PERSONAL FAN

(76) Inventor: Miklos Joseph Green, Houston, TX (US)

( * ) Notice: Subject to any disclaimer, the term of this patent is extended or adjusted under 35 U.S.C. 154(b) by 744 days.

(21) Appl. No.: 13/440,043

(22) Filed: Apr. 5, 2012

(65) Prior Publication Data

US 2013/0263364 A1 Oct. 10, 2013

(51) Int. Cl.
*A42B 3/28* (2006.01)

(52) U.S. Cl.
CPC ..... *A42B 3/286* (2013.01)

(58) Field of Classification Search
CPC ..... A42B 3/0406; A42B 3/281; A42B 3/283; A42B 3/285; A42B 3/286
USPC ..... 2/410, 6.2, 422, 171.3, DIG. 1
See application file for complete search history.

(56) References Cited

U.S. PATENT DOCUMENTS

| | | | | | |
|---|---|---|---|---|---|
| 3,353,191 | A * | 11/1967 | Dahly | 2/171.3 |
| 3,391,407 | A * | 7/1968 | Waters | 2/171.3 |
| 3,548,415 | A * | 12/1970 | Waters | 2/171.3 |
| 3,649,964 | A * | 3/1972 | Schoelz et al. | 128/205.25 |
| 3,813,696 | A * | 6/1974 | Yeager | 2/171.3 |
| 3,881,198 | A * | 5/1975 | Waters | 2/171.3 |
| 4,680,815 | A * | 7/1987 | Hirsch et al. | 2/171.3 |
| 4,893,356 | A * | 1/1990 | Waters | 2/171.3 |
| 5,085,231 | A * | 2/1992 | Johnson | 131/329 |
| 5,283,914 | A * | 2/1994 | James | 2/424 |
| 5,425,620 | A * | 6/1995 | Stroud | 416/63 |
| 5,561,855 | A * | 10/1996 | McFall | 2/8.6 |
| 5,561,862 | A * | 10/1996 | Flores, Sr. | 2/171.3 |
| 6,032,291 | A * | 3/2000 | Asenguah et al. | 2/171.3 |
| 6,393,617 | B1 * | 5/2002 | Paris et al. | 2/171.3 |
| 6,715,309 | B1 * | 4/2004 | Junkins | 62/259.3 |
| 7,143,451 | B2 * | 12/2006 | Lundgren | 2/171.3 |
| 7,290,292 | B1 * | 11/2007 | Nellon | 2/171.3 |
| 7,296,304 | B2 * | 11/2007 | Goldsborough | 2/171.3 |
| 7,331,064 | B1 * | 2/2008 | Quintal | 2/209.13 |
| 7,802,318 | B2 * | 9/2010 | Chen | 2/171.3 |
| 7,823,586 | B2 * | 11/2010 | Glazman | 128/201.25 |
| 7,921,473 | B1 * | 4/2011 | Winters | 2/171.3 |
| 8,136,169 | B2 * | 3/2012 | Taylor | 2/171.3 |
| 2006/0053528 | A1 * | 3/2006 | English | 2/171.3 |
| 2007/0061946 | A1 * | 3/2007 | Webb | 2/410 |
| 2008/0295220 | A1 * | 12/2008 | Webb | 2/171.3 |
| 2009/0055987 | A1 * | 3/2009 | Becker et al. | 2/8.6 |
| 2013/0160195 | A1 * | 6/2013 | Clement | 2/437 |
| 2014/0150163 | A1 * | 6/2014 | Hatton | 2/171.3 |

* cited by examiner

*Primary Examiner* — Alissa L Hoey
(74) *Attorney, Agent, or Firm* — Oakwood Law Group, LLP

(57) ABSTRACT

A hardhat personal fan of the present invention comprises a fan with duct delivery system designed to be mounted externally onto the rim of any hardhat requiring no modification to the hat. This allows for easy installation, use and un-installation. The design is small, sleek, light weight and attractive. The system provides constant cooling airflow to the lower face, neck, shoulders and upper body. Heat is expelled before it travels to the head, promoting cooling there also. The cooling airflow alleviates the potential for heat stroke, reduces fatigue, and increases a worker's endurance, dexterity, mental acuity, concentration and morale.

7 Claims, 13 Drawing Sheets

HARDHAT MOUNTED PERSONAL FAN

BACKGROUND OF THE INVENTION

1. Field of the Invention

The present invention relates to an air cooling device mounted on the hardhat and a hardhat incorporating said air cooling device, and more particularly to a removable hardhat mounted personal fan which includes a fan and duct delivery system installed along the rim of the hardhat to provide cooling airflow to a user's lower face, neck, shoulders and upper body. The present invention also relates to a hardhat incorporating said personal fan.

2. Description of Related Art

Environmental, Safety and Health (ES&H) has historically been regarded as a high priority by companies concerning their workers in the United States and abroad. This invention has been developed to enhance worker comfort, create a healthier working environment and increase safety. A few ideas have been advanced to implement cooling apparatuses located inside a hardhat or that require some modification to a hardhat.

More specifically, by way of example, U.S. Pat. No. 6,122,773 to Katz discloses a ventilated hardhat having an interior cavity and a plurality of vent holes therethrough. A fan is mounted to the hardhat in the interior cavity. A motor is also mounted to the hardhat in the interior cavity for rotating the fan to draw air through the vent holes into the interior cavity.

U.S. Pat. No. 6,760,925 to Maxwell discloses an air-conditioned hardhats which includes a motor and fan attached to the top of the interior of a hardhat to blow air over a coolant reservoir onto the wearer's head.

U.S. Pat. No. 4,744,106 to Wang discloses an engineering safety cap for providing both security and ventilation. The cap includes a cylindrical cover having a motor driven fan mounted therein and is pivotably mounted at one edge thereof to the cap such that the cover can be positioned inside the cap opening.

The installation of those devices is cumbersome and unappealing. The installation of those devices may be permanent, and when there is no need or desire for using those devices which could be troublesome. Moreover, those devices focus primarily on cooling the top of the head, forehead and face. Although the head releases much heat, other parts of the body absorb most of the heat. Previous designs largely omit cooling to these other parts of the body and thus the air is not being efficiently used. Furthermore, the air may cause discomfort to wear's eyes if the air is blown directly to the head and forehead. Therefore, there exist needs to have a hardhat mounted personal fan that can provide cooling air to other parts of the body. Moreover the hardhat mounted personal fan should be easy to install, use and un-install.

SUMMARY OF THE INVENTION

The Hardhat Mounted Personal Fan (HMPF) according to the principle of the present invention comprises a fan with duct delivery system designed to be mounted externally onto the rim of any hardhat requiring no modification to the hat. This allows for easy installation, use and un-installation. The design is small, sleek, light weight and attractive. The system provides constant cooling airflow to the lower face, neck, shoulders and upper body. Heat is expelled before it travels to the head, promoting cooling there also. The cooling airflow alleviates the potential for heat stroke, reduces fatigue, and increases a worker's endurance, dexterity, mental acuity, concentration and morale.

The materials of the HMPF are non-conductive. In one embodiment, the HMPF is powered by a switch-selectable dual rechargeable battery. It can operate for up to 13 hours before a recharge. It is explosion proof and suitable for NEC Class 1 and Class 2, Division 2 environments making it acceptable for refineries, chemical plants, manufacturing plants, mills, mines and all highway and construction projects.

One embodiment of the present invention comprises a motorized fan secured inside an enclosure which has at least one air entry vent to allow ambient air to be drawn into the fan enclosure, two power sources electrically connected to the fan for powering the fan, one switch (A) for selecting either power source, a second switch (B) electrically connected to the fan and power sources to control the fan, a duct delivery system consisting of two composite duct sections connected to the right and left side of the fan enclosure, and fastening means for removably securing the fan enclosure and duct assembly to the hardhat. Each duct assembly section includes a first duct connected to the fan enclosure and a second duct connected to the first duct through an air inlet end piece. The second duct is open on its bottom along its longitudinal axis for air to exit. The duct assembly further comprises a resistance rod which accelerates velocity of the air and allows for a balance of flexibility and rigidity of the second duct. The fastening means include spacers which are installed within the second duct to prevent the duct from collapsing. In operation, switch (B) actuates said fan to generate cooling airflow which travels into the two duct assembly sections and exits from the bottom opening on the second duct of each section, blowing downward onto to a wearer's face, neck, shoulders, and upper body.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

A hardhat mounted personal fan (HMPF) according to an embodiment of the present invention is typically placed on the brim of a hardhat or clamped to the rear of a hardhat so that the fan blows air onto a wearer's lower face, neck, shoulders, and upper body.

Figure 1A:
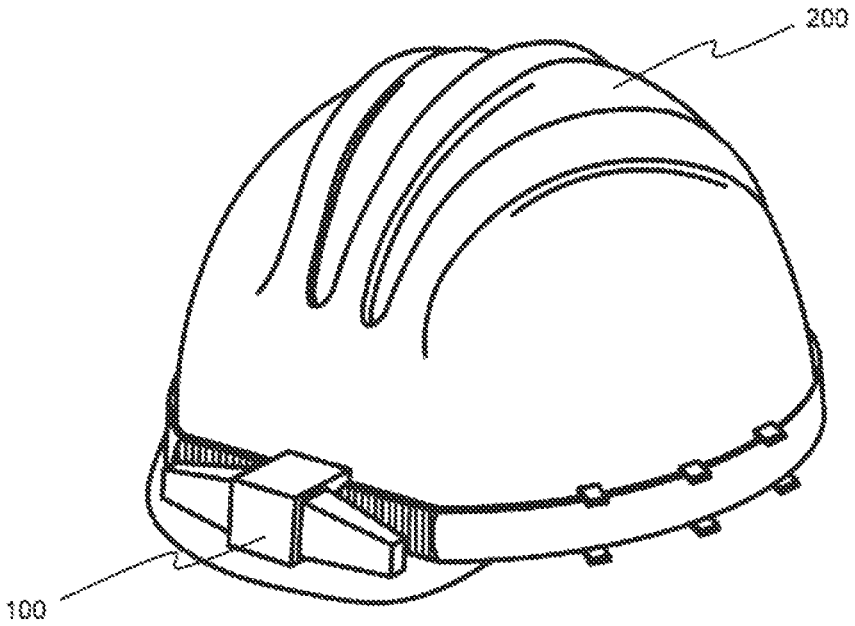
FIG. 1A is a perspective view of a standard sized hardhat incorporating a personal fan according to one embodiment of the invention on the front of the hardhat.
Figure 1B:
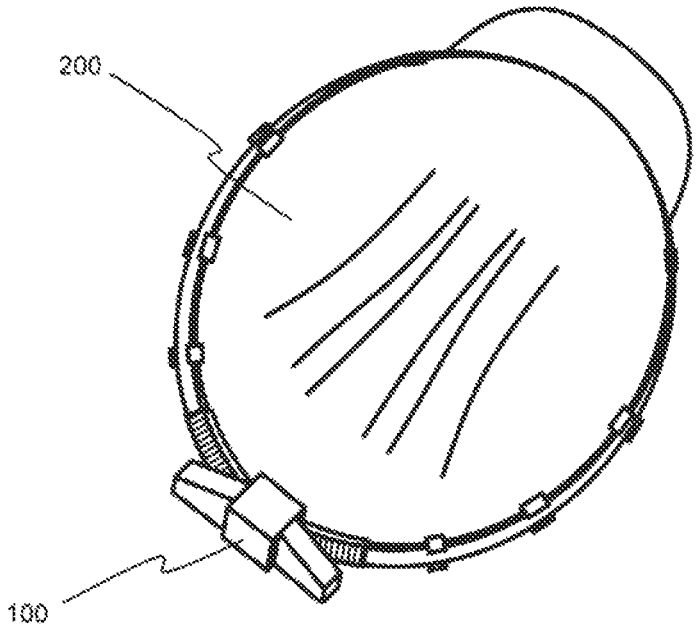
FIG. 1B is a perspective view of a standard sized hardhat incorporating a personal fan according to one embodiment of the invention on the rear of the hardhat.
Figure 1C:
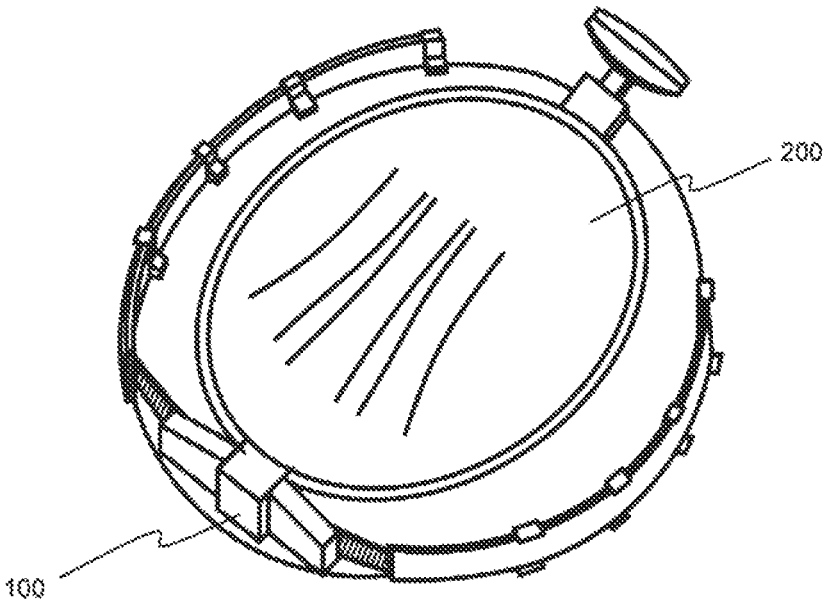
FIG. 1C is a perspective view of a wide brimmed hardhat incorporating a personal fan according to one embodiment of the invention on the rear of the hardhat.

Referring to FIG. 1A-1C, there are disclosed a HMPF 100 mounted on the front of a standard hat 200, on the rear of a standard hat 200, and on the rear of a wide brimmed hat 200.

Figure 2A:
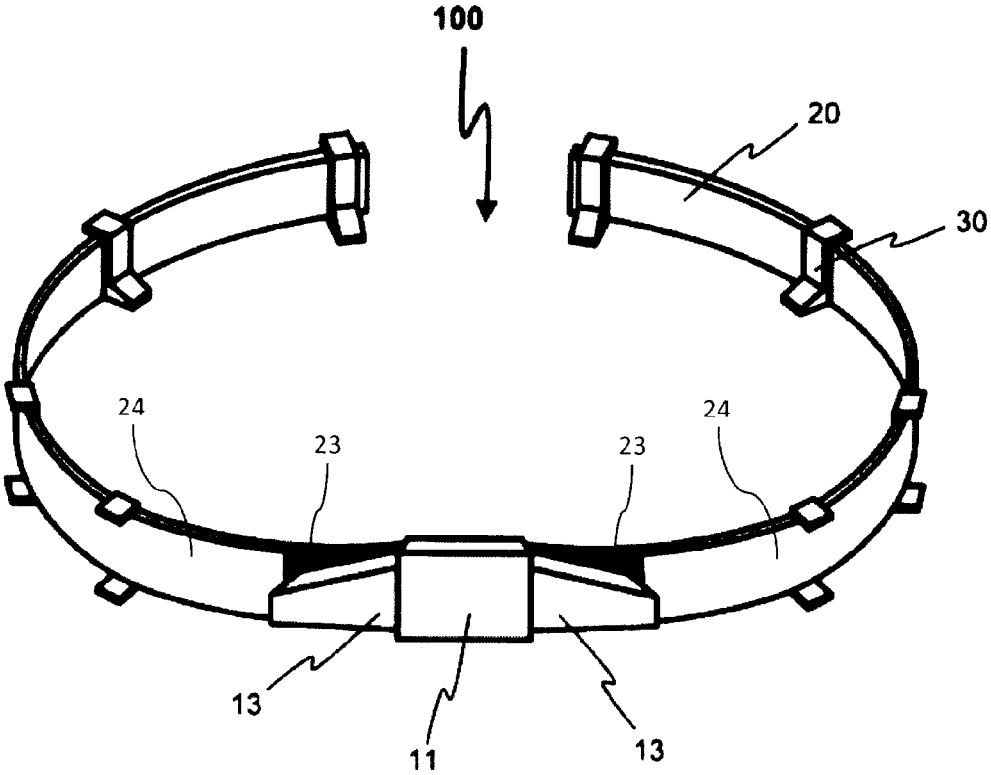
FIG. 2A is an isometric view of a hardhat mounted personal fan (HMPF) according to one embodiment of the invention.
Figure 2B:
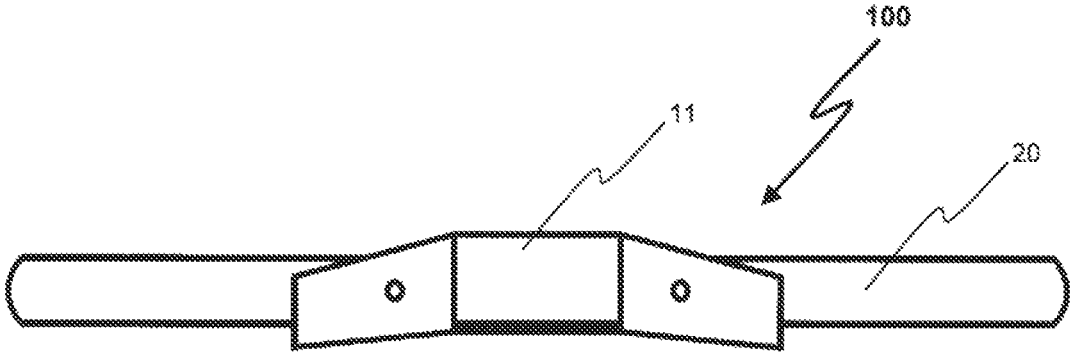
FIG. 2B is a front view of the HMPF of FIG. 2A.
Figure 2C:
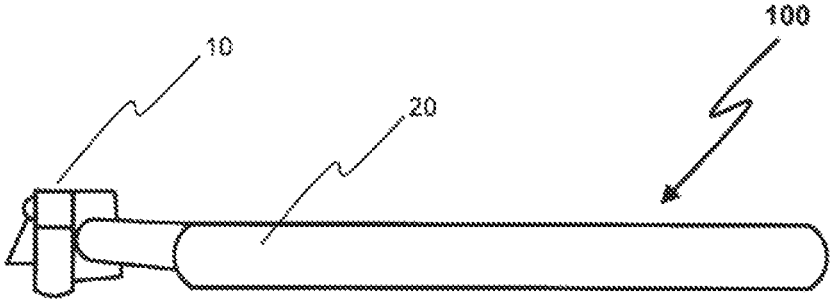
FIG. 2C is a side view of the HMPF of FIG. 2A.
Figure 3A:
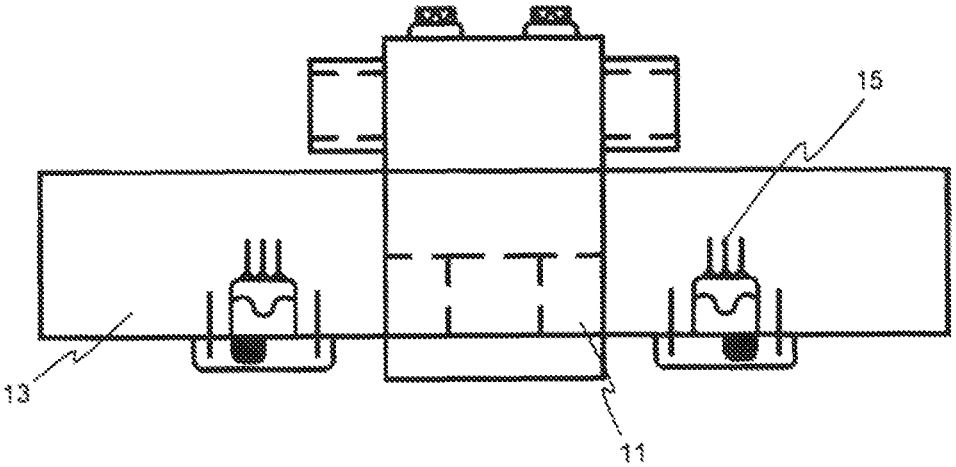
FIG. 3A is a top view of a fan and electrical enclosure of the HMPF according to one embodiment of the invention.
Figure 3B:
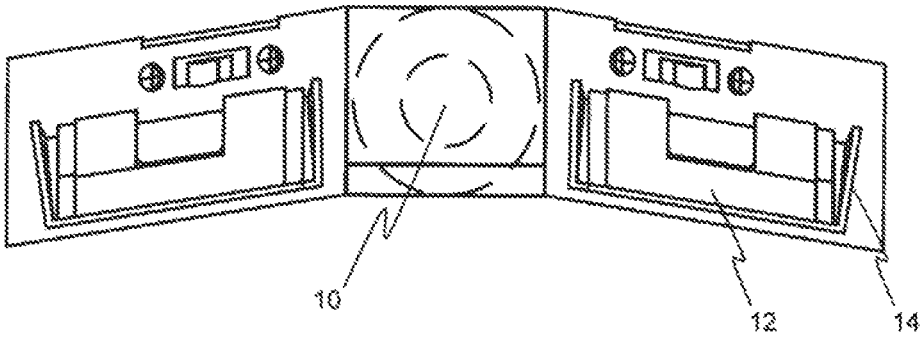
FIG. 3B is a front view of the fan and electrical enclosure of the HMPF of FIG. 3A.
Figure 3C:
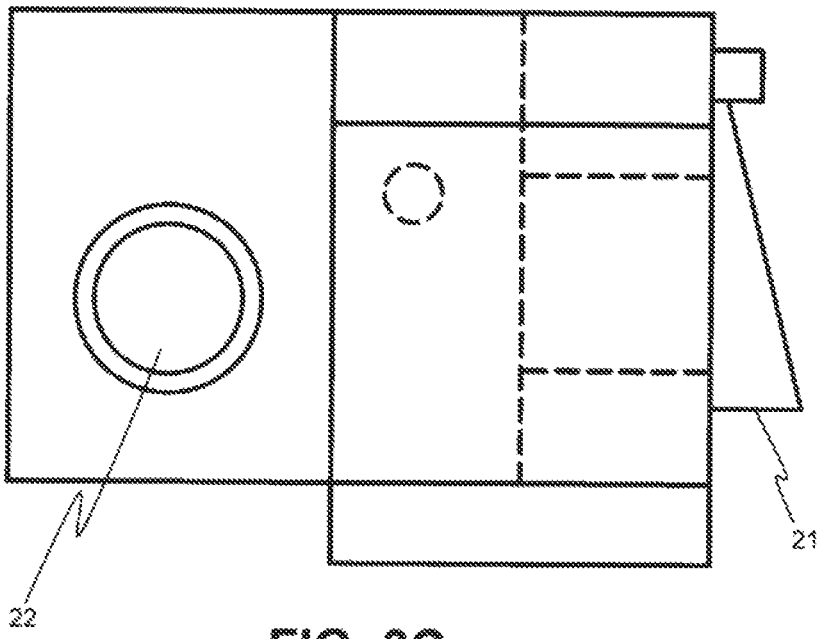
FIG. 3C is a side view of fan and electrical enclosure of the HMPF of FIG. 3A.

FIG. 2A-2C show the isomeric view, front view and side view of a HMPF 100 according to one embodiment of the invention. The HMPF 100 comprises a motorized fan 10 (not shown) secured inside an enclosure 11 preferably constructed from a lightweight plastic material but not limited thereto, a pair of battery packs 12 secured inside enclosures 13 to the right and left of the fan, and a pair of duct assemblies 20 which extends to the right and left from the fan enclosure 11 along the rim of a hat 200, and fastening means 30 which secure the fan enclosure 11 and duct assembly 20 to the hat 200. FIG. 3A-3C show the fan enclosure 11 for receiving an explosion proof fan 10 (FIG. 3B), weather shield, battery holders 14 for supporting batteries 12 (FIG. 3B) which supply power to rotate the fan 10, a hermetically sealed switch 15 connected with the battery packs 12 and fan 10 for selective actuation of the fan 10 and a hermetically sealed switch for selecting either battery pack. The fan enclosure 11 is connected to each duct assembly 20 and has an air entry vent 21 and two air exit ports 22 (FIG. 3C). The ambient air is drawn into the fan enclosure 11 through the air entry vent 21, and then the fan 12 being actuated by the switch 15 blows the (cooling) air through the air exit 22 into the duct assembly 20.

Figure 4:
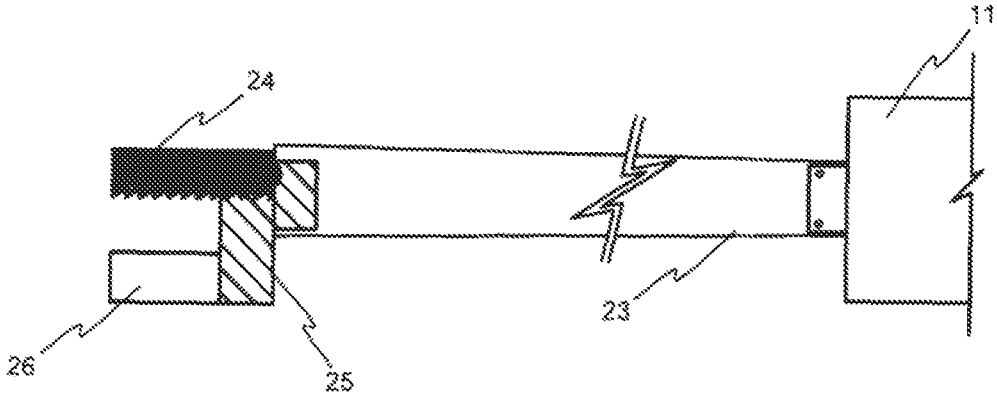
FIG. 4 is a side view showing the connection between the duct assembly and fan enclosure according to one embodiment of the invention.
Figure 5:
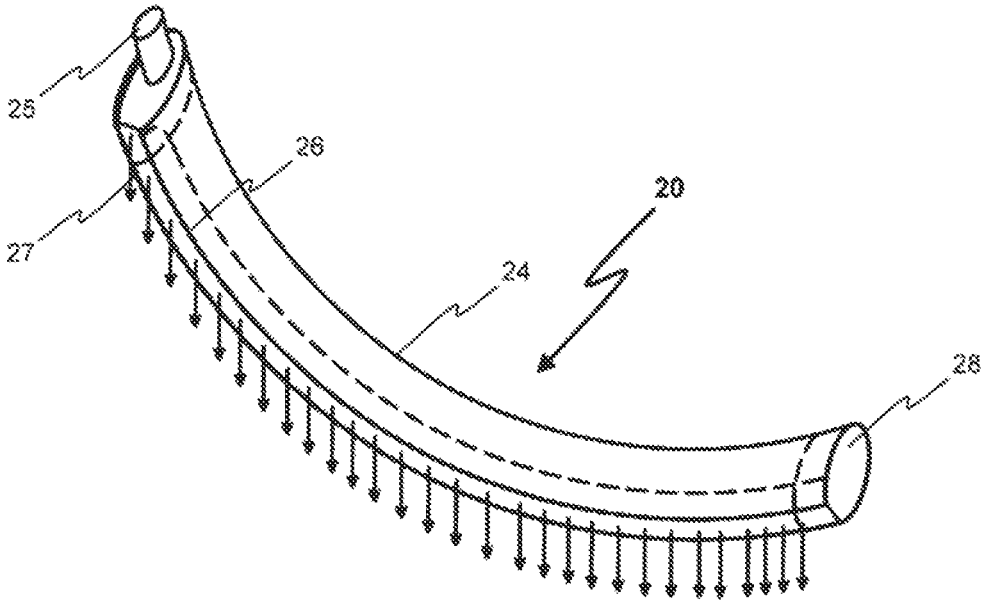
FIG. 5 is a perspective view of the second duct of the duct assembly according to one embodiment of the invention.
Figure 6:
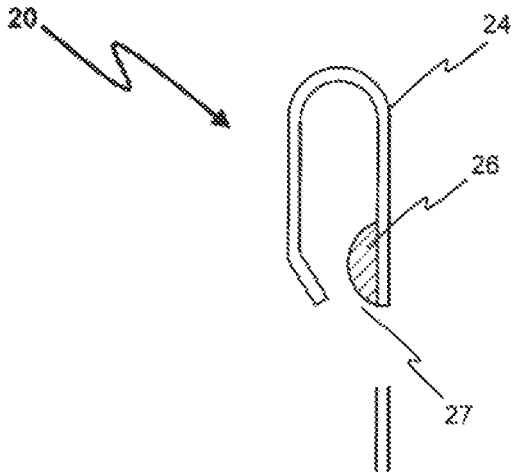
FIG. 6 is a cross-sectional view of the duct assembly shown in FIG. 2B.

As shown in FIG. 2A and FIG. 4, each of the two duct assembly sections 20 comprises a first duct 23 which is connected to fan enclosure 11, a second duct 24 connected to the first duct 23 via air inlet end piece 25, and resistance rod 26 located inside the second duct 24. The second duct 24 is open at the bottom along its longitudinal axis 27 for air to exit (as shown in FIG. 5) so that the cool airflow generated by the fan 10 can travel through the first duct 23 (shown in FIG. 4) via air inlet end piece 25 into the space within the second duct 24, then exit from the opening 27 and blow downward to a wearer's lower face, neck, shoulders and upper body. Heat is expelled before it travels to the head, promoting cooling there also. Referring back to FIG. 5, each duct assembly section 20 is closed at the opposite end 28 to the air inlet end piece 25 so that the cool air can be contained within the duct assembly 20 and blow downwardly to the user's lower face, neck, shoulders, and upper body. The first duct is round in shape and is approximately ⅜ of an inch in diameter. The first duct 23 is made of flexible and expandable material. In one embodiment, when in rest (non-expanded) it is approximately 1.5 inches long and may be extended up to 3 inches long if needed. The sectional view along the line 2-2 of FIG. 2B is shown in FIG. 6. In one preferred embodiment, the second duct 24 is approximately ¾ inch tall, ⅜ of an inch wide and 1 foot long. The wall of the second duct 24 is approximately 1/32 of an inch thick and is made of flexible material including but not limited to vinyl. The resistance rod 26 is approximately ¼ inch in width, ⅛ inch in radius, and 11½ inches in length affixed inside and at the bottom edge all around the second duct. The resistance rod is for the purpose of accelerating air velocity and providing some rigidity. The second duct is still flexible for mounting to various contours of hardhats.

Both of the air inlet end piece 25 and duct end piece 28 are preferably made of ABS plastic. The first duct and second duct may have different sizes and be made of different materials.

Figure 7:
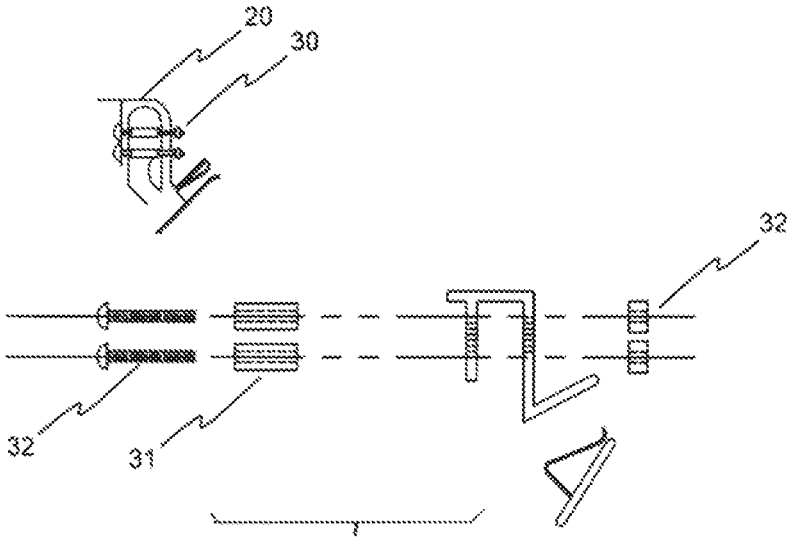
FIG. 7 is a view showing a mounting bracket assembly according to one embodiment of the invention and said bracket assembly mounted on the second duct of the duct assembly.

The duct assemblies 20 are secured to the brim of the hardhat 200 by fastening means 30 which include but are not limited to brackets as shown in FIG. 7. The set of brackets 30 comprise spacers 31 which are installed inside the second duct 24 to prevent the second duct 24 from collapsing; the spacers 31 are locked by screws 32 and nuts with lock washers 33. Other type of fastening means may be used for the same purpose.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A hardhat incorporating a personal fan comprising:

a hardhat; and a fan with duct delivery system configured to be mounted externally onto and encircle a rim of said hardhat, said fan with duct delivery system comprising:

at least one motorized fan secured inside a fan enclosure which has at least one air entry vent hole to allow ambient air to be drawn into;

two selectable power sources electrically connected to said fan for powering said fan;

at least one on/off switch electrically connected to said fan and said power sources to control said fan;

at least one selector switch for selection between two said power sources to power said fan;

two duct assemblies, one of said duct assemblies connected to a right side of said fan enclosure and another of said duct assemblies connected to a left side of said fan enclosure; each of said duct assemblies includes a first duct connected to said fan enclosure, and a second duct connected to said first duct through an air inlet end piece, said second duct having an open bottom along a longitudinal axis; and fastening structures configured for removably securing said fan enclosure and duct assemblies to said hardhat;

wherein each of said duct assemblies further comprises a resistance rod which is used to accelerate velocity of air flow and balance flexibility and rigidity of said second duct;

wherein said on/off switch actuates said fan to generate cooling airflow which travels into said duct assemblies and exits from said open bottom and blows downwardly along said brim of said hardhat.

2. The hardhat incorporating a personal fan according to claim 1, wherein said first duct is made of flexible and expandable material and is approximately 1.5 inches at a rest position and may be extended up to 3 inches if necessary.

3. The hardhat incorporating a personal fan according to claim 1, wherein said second duct is made of flexible material including vinyl.

4. The hardhat incorporating a personal fan according to claim 1, wherein said fastening structures include spacers which are installed inside said second duct to prevent said second duct from collapsing.

5. The hardhat incorporating a personal fan according to claim 1, wherein said resistance rod is approximately ¼ inch in width, ⅛ inch in radius, and 11½ inches in length.

6. The hardhat incorporating a personal fan according to claim 1, wherein said second duct is approximately ¾ inch tall, ⅜ inch wide, and one foot long and has a 1/32 inch thick wall made of flex vinyl material.

7. The hardhat incorporating a personal fan according to claim 1, wherein said power sources comprise two switch selectable batteries.

* * * * *